US007165606B2

(12) United States Patent
Take

(10) Patent No.: US 7,165,606 B2
(45) Date of Patent: Jan. 23, 2007

(54) HEAT EXCHANGING TUBE AND HEAT EXCHANGER

(75) Inventor: Koichiro Take, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/529,632

(22) PCT Filed: Oct. 1, 2003

(86) PCT No.: PCT/JP03/12616

§ 371 (c)(1),
(2), (4) Date: Sep. 28, 2005

(87) PCT Pub. No.: WO2004/031676

PCT Pub. Date: Apr. 5, 2004

(65) Prior Publication Data

US 2006/0151160 A1 Jul. 13, 2006

Related U.S. Application Data

(60) Provisional application No. 60/421,082, filed on Oct. 25, 2002.

(30) Foreign Application Priority Data

Oct. 2, 2002 (JP) ..... 2002-290180
Sep. 19, 2003 (JP) ..... 2003-327179

(51) Int. Cl.
*F28F 1/04* (2006.01)
*F28F 9/02* (2006.01)

(52) U.S. Cl. ..... 165/177; 165/179; 165/175

(58) Field of Classification Search ..... 165/174–175, 165/177, 179, 183; 138/38; 29/890.05, 29/890.053

See application file for complete search history.

(56) References Cited

U.S. PATENT DOCUMENTS

| | | | | |
|---|---|---|---|---|
| 6,000,467 | A * | 12/1999 | Tokizaki et al. | 165/134.1 |
| 6,209,202 | B1 * | 4/2001 | Rhodes et al. | 29/890.053 |
| 6,289,981 | B1 * | 9/2001 | Tokizaki et al. | 165/177 |
| 6,340,055 | B1 * | 1/2002 | Yamauchi et al. | 165/174 |
| 6,854,512 | B1 * | 2/2005 | Lee et al. | 165/174 |
| 6,880,627 | B1 * | 4/2005 | Sanada et al. | 165/152 |
| 2001/0004014 | A1 * | 6/2001 | Dienhart et al. | 165/183 |
| 2004/0069477 | A1 * | 4/2004 | Nishikawa et al. | 165/175 |

FOREIGN PATENT DOCUMENTS

| | | | |
|---|---|---|---|
| JP | 6-142755 | | 5/1994 |
| JP | 6-300473 | | 10/1994 |
| JP | 2000154987 | A * | 6/2000 |
| JP | 2000-356488 | | 12/2000 |
| WO | 02/42706 | | 5/2002 |

* cited by examiner

*Primary Examiner*—Tho Duong
(74) *Attorney, Agent, or Firm*—Oblon, Spivak, McClelland, Maier & Neustadt, P.C.

(57) ABSTRACT

A heat exchanging tube is provided with a flat tube main body having a predetermined length and a plurality of refrigerant passages extending in a tube longitudinal direction and arranged in a tube widthwise direction. The following relational equations (a) to (c) are satisfied: W=6 to 18 mm . . . (a); Ac/At×100=50 to 70% . . . (b) and P/L×100=350 to 450% . . . (c), where "W" is a width of the tube main body, "Ac" is a total cross-sectional area of the refrigerant passages, "At" is a total cross-sectional area of the tube main body ( including the refrigerant passages), "L" is an external perimeter of the tube main body and "P" is a total inner perimeter of the refrigerant passages. With this tube, enough pressure strength can be obtained and the passage resistance can be decreased while keeping the light weight, and further the heat exchanging performance can be improved.

16 Claims, 5 Drawing Sheets

HEAT EXCHANGING TUBE AND HEAT EXCHANGER

Priority is claimed to Japanese Patent Application No. 2002-290180, filed on Oct. 2, 2002, U.S. Provisional Patent Application No. 60/421,082, filed on Oct. 25, 2002 and Japanese Patent Application No. 2003-327179, filed on Sep. 19, 2003, the disclosure of which are incorporated by reference in their entireties.

CROSS-REFERENCE TO RELATED APPLICATIONS

This application is an application filed under 35 U.S.C. § 111(a) claiming the benefit pursuant to 35 U.S.C. § 119(e)(1) of the filing date of Provisional Application No. 60/421,082 filed on Oct. 25, 2002 pursuant to 35 U.S.C. § 111(b).

TECHNICAL FIELD

The present invention relates to a heat exchanger such as a condenser or an evaporator for use in a refrigeration cycle of automobile air-conditioners, household air-conditioners, refrigerators, electronics device coolers or the like, and also relates to a heat exchanging tube thereof.

BACKGROUND ART

The following description sets forth the inventor's knowledge of related art and problems therein and should not be construed as an admission of knowledge in the prior art.

As conventional condensers for use in a refrigeration cycle of automobile air-conditioners, the so-called multi-flow type heat exchangers are widely employed. One example of such a condenser is shown in International Publication No. WO 02/42706.

This heat exchanger is provided with a pair of vertical headers and a plurality of heat exchanging tubes arranged in parallel along the up-and-down direction with their opposite ends connected to the headers. The plurality of heat exchanging tubes are classified by partitions provided in the headers to thereby form a plurality of passes. A gaseous refrigerant introduced into the refrigerant inlet of one of the headers passes through each pass in turn to thereby be condensed and liquefied, and then flows out of the refrigerant outlet of one of the headers.

The size of such a heat exchanger is decided by, for example, the required heat rejection performance and the size of the installation space. A common heat exchanging tube is flat in cross-section with a width of about 20 mm.

Such a heat exchanger is usually mounted in vehicles such as automobiles or trucks. In recent years, such vehicles are strongly required to be light in weight for the purpose of improving the fuel economy and/or decreasing toxic emission gas (e.g., $CO_2$, $NO_x$). Accordingly, every kinds of automobile parts are required to be light in weight, and therefore the aforementioned heat exchangers are not exceptional.

Under the circumstances, in order to reduce the weight of heat exchanger, it can be contemplated to reduce the height of heat exchanging tube, reduce the thickness of external peripheral wall of the heat exchanging tube or reduce the thickness of external heat releasing fin disposed between the adjacent heat exchanging tubes.

Such methods for decreasing weight are, however, considered to be reached a limit, and a further attempt to decrease the weight based on such methods causes decreased inherent heat exchanging performance. For example, if the tube height is set to be lower, the inner perimeter of each refrigerant flow path becomes shorter, causing deteriorated heat releasing performance. If the thickness of the tube external peripheral wall is set to be thinner, the pressure resistance deteriorates. Further, if the fin thickness is set to be thinner, the temperature difference between the portion of the fin which is in contact with the tube and the central portion of the fin becomes larger, causing deteriorated heat releasing performance.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

DISCLOSURE OF INVENTION

It is an object of the present invention to provide a heat exchanging tube capable of improving heat exchanging performance and decreasing passage resistance while decreasing the weight and obtaining enough pressure resistance.

It is another object of the present invention to provide a heat exchanger capable of improving heat exchanging performance and decreasing passage resistance while decreasing the weight and obtaining enough pressure resistance.

The inventors have found optimum conditions capable of attaining the aforementioned objects of a heat exchanging tube and a heat exchanger after conducting various detail analysis of a structure of a heat exchanging tube for use in condensers and the like and repeatedly performing detail experiments/studies based on the analysis.

According to the first aspect of the present invention, (1) A heat exchanging tube provided with a flat tube main body having a predetermined length and a plurality of refrigerant passages extending in a tube longitudinal direction and arranged in a tube widthwise direction, wherein the following relational equations are satisfied:

$$W=6 \text{ to } 18 \text{ mm} \quad \text{(a)},$$

$$Ac/At\times 100=50 \text{ to } 70\% \quad \text{(b) and}$$

$$P/L\times 100=350 \text{ to } 450\% \quad \text{(c)},$$

where "W" is a width of the tube main body; "Ac" is a total ross-sectional area of the refrigerant passages, "At" is a total cross-sectional area of the tube main body (including the refrigerant passages), "L" is an external perimeter of the tube main body and "P" is a total inner perimeter of the refrigerant passage.

The heat exchanging tube according to the heat exchanging tube for use in heat exchanges as defined in the aforementioned item (1) (first aspect of the present invention) is applied to the so-called multi-flow type heat exchanger for use in condensers and the like in a refrigerant cycle of an automobile air-conditioner as shown in FIGS. 1 and 2.

The heat exchanger is provided with a pair of vertical headers 50 and 50, a plurality of heat exchanging tubes 60 arranged in parallel with the opposite ends thereof connected to the headers 50 and 50, fins 51 disposed between the adjacent tubes 60 and outside the outermost tubes 60 and side plates 52 disposed outside the outermost fins 51. The heat exchanging tubes 60 are classified by partitions 53 provided in the headers 50 and 50 into a plurality of passes C1 to C3. The gaseous refrigerant introduced via the refrigerant inlet 50*a* provided at the upper portion of one of the headers 50 passes through each pass C1 to C3 in a meandering manner while being exchanged with the ambient air to be condensed and liquefied, and then flows out of the refrigerant outlet 50*b* provided at the lower portion of the other header 50.

The tube 60 of this heat exchanger is an extruded tube made of aluminum (or its alloy).

As shown in FIGS. 3 and 4, this heat exchanging tube 60 has a flat tube main body 60 with a height H smaller than the width W.

The tube main body 61 is provided with an external peripheral wall 63 and partitioning walls 64 integrally formed in the inner side of the external peripheral wall 63. Each partitioning wall 64 connects the upper wall and the lower wall constituting the external peripheral wall 63 and extends in the tube longitudinal direction. Thus, the inside space of the external peripheral wall 63 of the tube main body 61 is partitioned by each partitioning wall 64 so that a plurality of refrigerant passages 65 rectangular in cross-section are arranged in the tube widthwise direction and extends along the tube longitudinal direction.

In the heat exchanging tube 60 according to the present invention, it is required to satisfy the aforementioned relational equations (a) to (c).

The relational equation (a) specifies a tube width W. It is required to set the tube width W to be 6 to 18 mm because of the following reasons. If the tube width W is too wide (i.e., more than 18 mm), the tube becomes too heavy, which in turn makes it difficult to attain the initial object. To the contrary, if the width W is too narrow (i.e., less than 6 mm), it is difficult to keep an enough size of the refrigerant passage 65, causing increased refrigerant passage resistance and decreased inner perimeter of the refrigerant passage 65, which makes it difficult to obtain enough heat exchanging performance. The preferable tube width W is 6 to 14 mm, more preferably 7 to 12 mm.

The relational equation (b) specifies the relationship between the total cross-sectional area "Ac" of the refrigerant passages 65 and the total cross-sectional area "At" of the tube main body 61 including the refrigerant passages 65. It is necessary to set the "Ac/At×100" to be 50 to 70%. More preferable range is 55 to 65%. If "Ac/At" is too small (i.e., less than 50%), the refrigerant passage resistance becomes larger, causing increased pressure loss and increased tube weight. To the contrary, if "Ac/At" is too large (i.e., more than 70%), the passage cross-sectional area increases, causing decreased refrigerant flow rate, which in turn causes decreased heat transfer coefficient.

The relational equation (c) specifies the relationship between the external perimeter L of the tube main body 61 and the total inner perimeter P of the refrigerant passages 65. It is necessary to set "P/L×100" to be 350 to 450%. More preferably, it is set to be 360 to 420%. If the "P/L" is too small (i.e., less than 350%), the heat transfer performance deteriorates, causing insufficient heat exchanging performance as a heat exchanger. To the contrary, if "P/L" is too larger (i.e., more than 450%), it is required to prepare an extruding die having a fine configuration in the case in which the tube is constituted by an aluminum extruded article, which makes it difficult to manufacture the tube. Furthermore, even in the case of employing a three dimensional configuration forming method or a roll forming method for forming communication passages (refrigerant passages), the die having a fine configuration is required, which makes it difficult to manufacture the tube.

In a heat exchanger having the heat exchanging tubes according to the first aspect of the present invention, since the heat exchanging tube has the structure as defined by the aforementioned Item (1), enough pressure resistance can be obtained while keeping the weight light, and the passage resistance can be decreased, which in turn can improve the heat exchanging performance.

In the first aspect of the present invention, it is preferable to employ the structures as defined by the following Items (2) to (7).

(2) A heat exchanging tube as recited in the aforementioned Item (1), wherein the following relational equation (d) is satisfied:

$$P/W \times 100 = 750 \text{ to } 850\% \quad \text{(d)}$$

The Item (2) specifies the relationship between the total inner perimeter P of the tube main body 61 and the tube width W. It is preferable to set "P/W×100" to be 750 to 850%. If "P/W" falls outside the above specified range, preferable passage configuration cannot be obtained, which may cause deterioration of heat exchanging performance due to the increased passage resistance and/or deteriorated heat transmission performance.

(3) A heat exchanging tube as recited in the aforementioned Item (1) or (2), wherein the following relational equation (e) is satisfied:

$$N/W = 3 \text{ to } 4 \text{ (pieces/mm)} \quad \text{(e)},$$

where "N" is the number of the refrigerant passages.

This Item (3) specifies the relationship between the number N of the refrigerant passages 65 and the tube width W. It is preferable to set "N/W" to be 3 to 4 (pieces/mm). If the "N/W" is too small (i.e., less than 3 pieces/mm), the number of the partitioning walls 64 arranged in the widthwise direction of the tube decreases, which may causes deteriorated pressure resistance. To the contrary, if the "N/W" is too large (i.e., more than 4 pieces/mm), the width of the passage 65 becomes too small, causing increased passage resistance, which may cause deteriorated heat exchanging performance.

(4) A heat exchanging tube as recited in the aforementioned Item (1), wherein the following relational equation (f) is satisfied:

$$H = 0.5 \text{ to } 1.5 \text{ mm} \quad \text{(f)},$$

where "H" is a height of the tube main body.

The Item (4) specifies the tube height H. It is preferable that the tube height H is set to be 0.5 to 1.5 mm. If the tube height H is too large (i.e., more than 1.5 mm), the tube size increases, causing a heavy tube, which in turn makes it difficult to attain the initial object. To the contrary, if the tube height H is too small (i.e., less than 0.5 mm), it becomes impossible to secure enough size of refrigerant passage 65, which causes increased refrigerant passage resistance and deteriorated heat releasing performance due to the decreased inner perimeter of the refrigerant passage. This makes it difficult to obtain sufficient heat exchanging performance.

In order to set the tube height H to be less than 0.5 mm, if the thickness of the external peripheral wall 63 of the tube main body 61 is decreased to thereby increase the size of the refrigerant passage 65, the pressure resistance of the external peripheral wall 63 may deteriorate, which in turn may cause deterioration of the pressure resistance of the entire tube.

(5) A heat exchanging tube as recited in one of the aforementioned Items (1) to (4), wherein the following relational equation (g) is satisfied:

$$Ta=50 \text{ to } 80\ \mu m \quad (g),$$

where "Ta" is a thickness of the partitioning wall partitioning adjacent refrigerant passages in the tube main body.

The item (5) specifies the thickness Ta of the partitioning wall 64 partitioning adjacent refrigerant passages in the tube main body 61. It is more preferable that the thickness Ta of the partitioning wall is set to be 50 to 80 μm. If the thickness Ta is too small (i.e., less than 50 μm), the strength of the partitioning wall 64 deteriorates, which makes it difficult to secure enough pressure resistance. To the contrary, if the thickness Ta is too large (i.e., more than 80 μm), it is impossible to secure enough size of the refrigerant passage, increasing refrigerant passage resistance, which in turn may cause deteriorated heat exchanging performance.

(6) A heat exchanging tube as recited in any one of the aforementioned Items (1) to (5), wherein the following relational equation (h):

$$Tb=80 \text{ to } 250\ \mu m \quad (h),$$

where "Tb" is the thickness of the external peripheral wall in the tube main body.

The Item (6) specifies the thickness Tb of the external peripheral wall 63 in the tube main body 61. It is more preferable that the thickness Tb is set to be 80 to 250 μm. If the thickness Tb is too thin (i.e., less than 80 μm), the strength of the external peripheral wall 63 deteriorates, which makes it difficult to secure enough pressure resistance. To the contrary, if the thickness Tb of the external peripheral wall is too thick (i.e., more than 250 μm), enough size of the refrigerant passage 65 cannot be secured, increasing the refrigerant passage resistance, which in turn may cause deterioration of the heat exchanging performance.

(7) A heat exchanging tube as recited in any one of the aforementioned Items (1) to (6), wherein the refrigerant passage is approximately rectangular in cross-section.

In the Item (7), since the refrigerant passage 65 is formed into an approximately rectangular (square) in cross-section, the inner perimeter of the refrigerant passage 65 and the refrigerant passage cross-sectional area can be kept large as compared with a refrigerant passage having a round cross-section. Accordingly, in the structure defined by Item (7), the heat releasing resistance can be decreased and the passage resistance can be decreased, which can further improve the heat exchanging performance.

The preferable structure of Items (2) to (7) can also be applied to the second to fourth aspects of the present invention which will be explained later, and the same effects as mentioned above can be obtained.

According to the second aspect of the present invention, (8) A heat exchanging tube provided with a plurality of refrigerant passages in a flat tube main body having a predetermined length, the refrigerant passage extending in a direction of a tube longitudinal direction and being arranged in parallel in a tube widthwise direction, wherein the following relational equations (a), (f), (g) and (h) are satisfied:

$$W=6 \text{ to } 18 \text{ mm} \quad (a),$$

$$H=0.5 \text{ to } 1.5 \text{ mm} \quad (f),$$

$$Ta=50 \text{ to } 80\ \mu m \quad (g) \text{ and}$$

$$Tb=80 \text{ to } 250\ \mu m \quad (h),$$

where "W" is a width of the tube main body, "H" is a height of the tube main body, "Ta" is a thickness of a partitioning wall partitioning adjacent refrigerant passages in the tube main body, "Tb" is a thickness of an external peripheral wall of the tube main body.

The heat exchanging tube according to the present invention (second aspect of the present invention) as recited in Item (8) can secure enough pressure resistance while keeping it light in weight, decrease the passage resistance and improve the heat exchanging performance in the same manner as in the first aspect of the present invention when the heat exchanging tube is applied to a heat exchanger.

According to the third aspect of the present invention, (9) A heat exchanger provided with a pair of headers and a plurality of heat exchanging tubes arranged in parallel in a header length direction, opposite ends of the heat exchanging tube being connected to the headers in fluid communication, wherein the heat exchanging tube is provided with a flat tube main body having a predetermined length and a plurality of refrigerant passages extending in a tube longitudinal direction and arranged in a tube widthwise direction, and wherein the following relational equations(a) to (c) are satisfied:

$$W=6 \text{ to } 18 \text{ mm} \quad (a),$$

$$Ac/At \times 100=50 \text{ to } 70\% \quad (b) \text{ and}$$

$$P/L \times 100=350 \text{ to } 450\% \quad (c),$$

where "W" is a width of the tube main body, "Ac" is a total cross-section&l area of the refrigerant passages; "At" is a total cross-sectional area of the tube main body (including the refrigerant passages), "L" is an external perimeter of the tube main body and "P" is a total inner perimeter of the refrigerant passage.

Since the invention (third aspect of the present invention) as recited in Item (9) specifies a heat exchanger using the heat exchanging tube of the first aspect of the present invention, it is possible to secure enough pressure resistance while keeping it light in weight, decrease the passage resistance and improve the heat exchanging performance in the same manner as in the first aspect of the present invention.

According to the fourth aspect of the present invention,

(10) A heat exchanger provided with a pair of headers and a plurality of heat exchanging tubes arranged in parallel in a header length direction, opposite ends of the heat exchanging tube being connected to the headers in fluid communication, wherein the heat exchanging tube is provided with a flat tube main body having a predetermined length and a plurality of refrigerant passages extending in a tube longitudinal direction and arranged in a tube widthwise direction, and wherein the following relational equations (a), (f), (g) and (h) are satisfied:

$$W=6 \text{ to } 18 \text{ mm} \quad (a),$$

$$H=0.5 \text{ to } 1.5 \text{ mm} \quad (f),$$

$$Ta=50 \text{ to } 80\ \mu m \quad (g) \text{ and}$$

$$Tb=80 \text{ to } 250\ \mu m \quad (h),$$

where "W" is a width of the tube main body, "H" is a height of the tube main body, "Ta" is a thickness of a partitioning wall partitioning adjacent refrigerant passages in the tube main body, "Tb" is a thickness of an external peripheral wall of the tube main body.

Since the invention (fourth aspect of the present invention) as recited in Item (10) specifies a heat exchanger using the heat exchanging tube of the second aspect of the present invention, it is possible to secure enough pressure resistance while keeping it light in weight, decrease the passage resistance and improve the heat exchanging performance in the same manner as in the first aspect of the present invention.

In the aforementioned first to fourth aspects of the present invention, the preferable range of the tube width W is 6 to 14 mm in the same manner as in the first aspect of the present invention.

According to the first to fourth aspects of the present invention, it is possible to secure enough pressure resistance while keeping it light in weight, decrease the passage resistance and improve the heat exchanging performance in the same manner as in the first aspect of the present invention.

Other objects and advantages of the present invention will be apparent from the following preferred embodiments

EXAMPLES

| | Ac $mm^2$ | At $mm^2$ | P mm | L mm | Ac/At % | P/L % | N pieces | H mm | W mm | P/W % | N/W pieces/mm | Ta mm | Tb mm |
|---|---|---|---|---|---|---|---|---|---|---|---|---|---|
| Ex. 1 | 5.29 | 8.92 | 64.1 | 17.3 | 59 | 371 | 28 | 1.15 | 8 | 801 | 3.50 | 0.06 | 0.1 |
| Ex. 2 | 8.36 | 13.5 | 101.2 | 25.3 | 62 | 400 | 44 | 1.15 | 12 | 843 | 3.67 | 0.06 | 0.1 |
| Ex. 3 | 11.3 | 18.1 | 131.8 | 33.3 | 63 | 396 | 57 | 1.15 | 16 | 824 | 3.56 | 0.06 | 0.1 |
| Comp. Ex. 1 | 22 | 46.1 | 55 | 35.4 | 48 | 155 | 4 | 3 | 16 | 344 | 0.25 | 0.5 | 0.5 |
| Comp. Ex. 2 | 7.15 | 18.1 | 74.7 | 32.1 | 40 | 233 | 28 | 1.15 | 16 | 467 | 1.75 | 0.14 | 0.2 |
| Comp. Ex. 3 | 4.16 | 18.1 | 59.8 | 32.1 | 23 | 186 | 26 | 1.15 | 8 | 748 | 3.25 | 0.1 | 0.1 |
| Comp. Ex. 4 | 6.05 | 18.1 | 73.3 | 32.1 | 33 | 228 | 32 | 1.15 | 8 | 916 | 4.00 | 0.03 | 0.1 |

Ac: total cross-sectional area of the refrigerant passages
At: cross-sectional area of the tube main body
P: total inner perimeter of the refrigerant passages
L: external perimeter of the tube main body
N: the number of refrigerant passages
H: height of the tube main body
W: with of the tube main body
Ta: thickness of the partitioning wall
Tb: thickness of the external peripheral wall

Example 1

Figure 3:
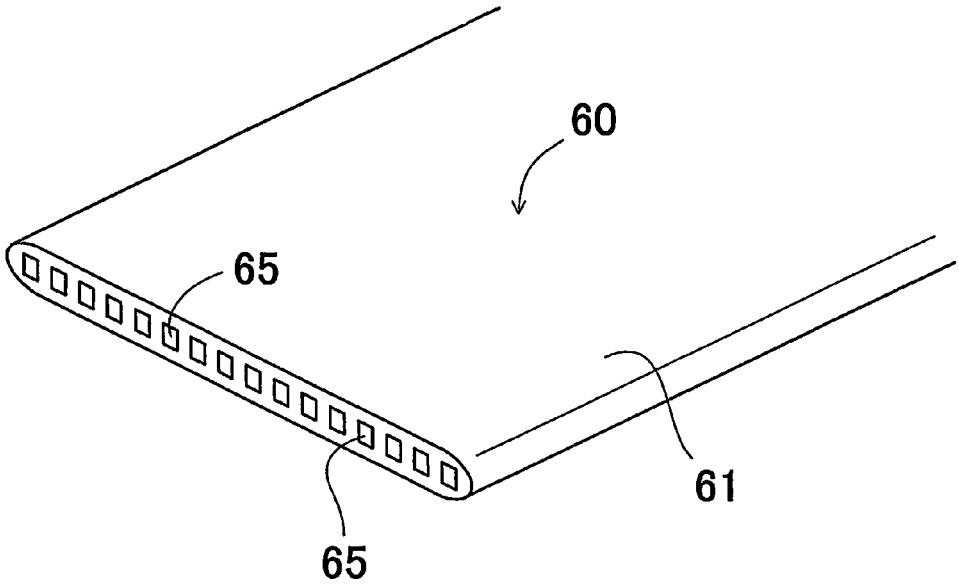
FIG. 3 is a perspective view showing the heat exchanging tube related to the present invention.
Figure 4:
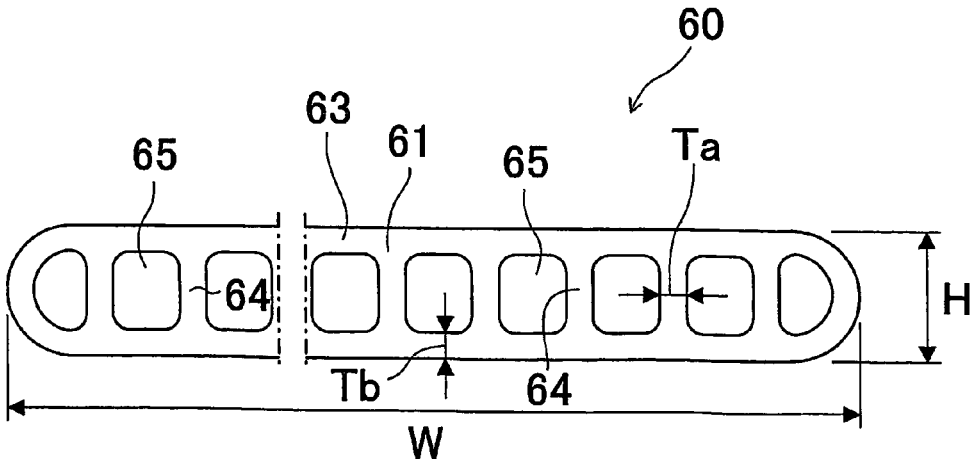
FIG. 4 is a cross-sectional view showing the heat exchanging tube related to the present invention.

Heat exchanging tubes according to the aforementioned embodiment (shown in. FIGS. 3 and 4) were manufactured. As shown in Table 1, the total cross-sectional area Ac of the refrigerant passages was set to be 5.29 $mm^2$, the total cross-sectional area At of the tube main body was set to be 8.92 $mm^2$, the total inner perimeter P of the refrigerant passages was set to be 64.1 mm, the external perimeter L of the tube main body was set to be 17.3 mm, the total cross-sectional area of the refrigerant passages relative to the total cross-sectional area of the tube main body Ac/At was set to be 59%, the total inner perimeter of the refrigerant passages relative to the external perimeter of the tube main body P/L was to set to 371%, the number of the refrigerant passages was set to be 28 pieces, the tube height H was set to be 1.15 mm, the tube width W was set to be 8 mm, the total inner perimeter of the refrigerant passages relative to the tube width P/W was set to be 801%, the number of passages relative to the tube width N/W was set to be 3.50 pieces/mm, the thickness Ta of the partitioning wall of the tube main body was set to be 0.06 mm, and the thickness Tb of the external peripheral wall was to be 0.1 mm.

Figure 1:
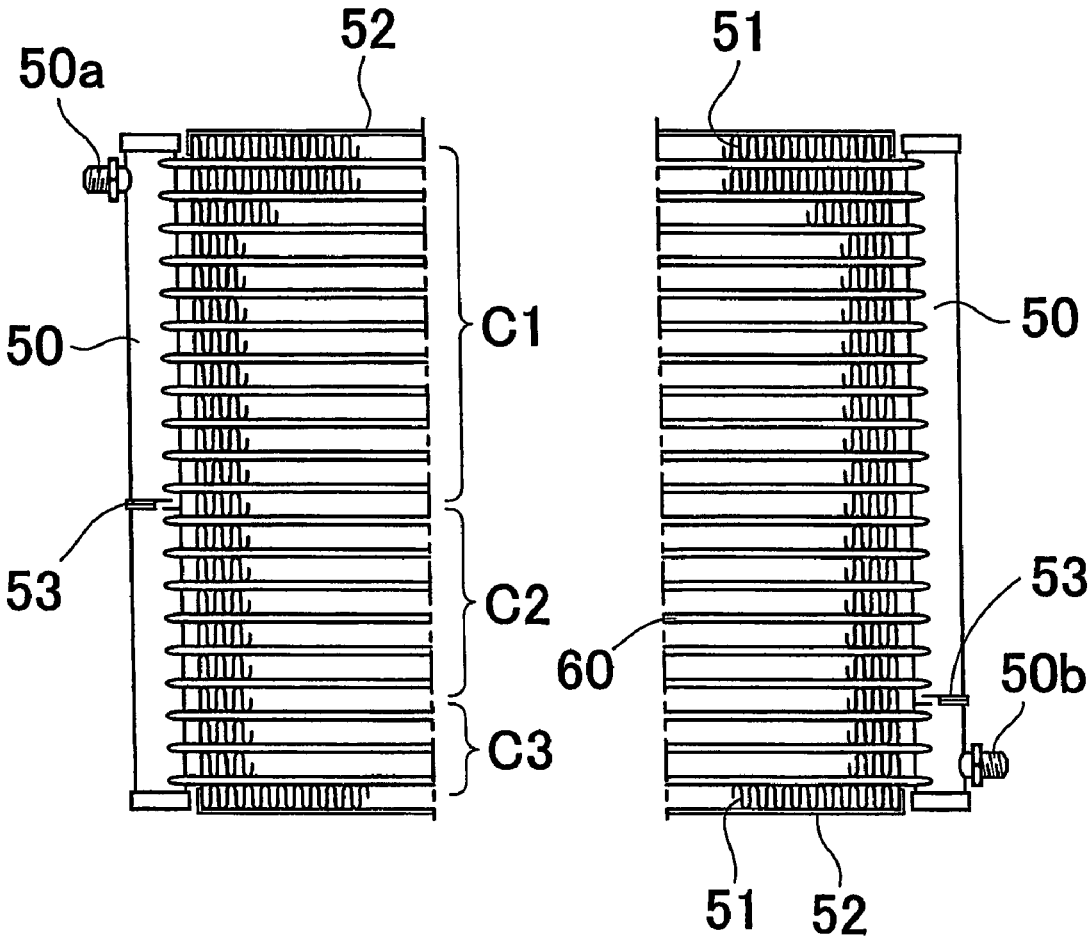
FIG. 1 is a front view showing a heat exchanger related to the present invention.
Figure 2:
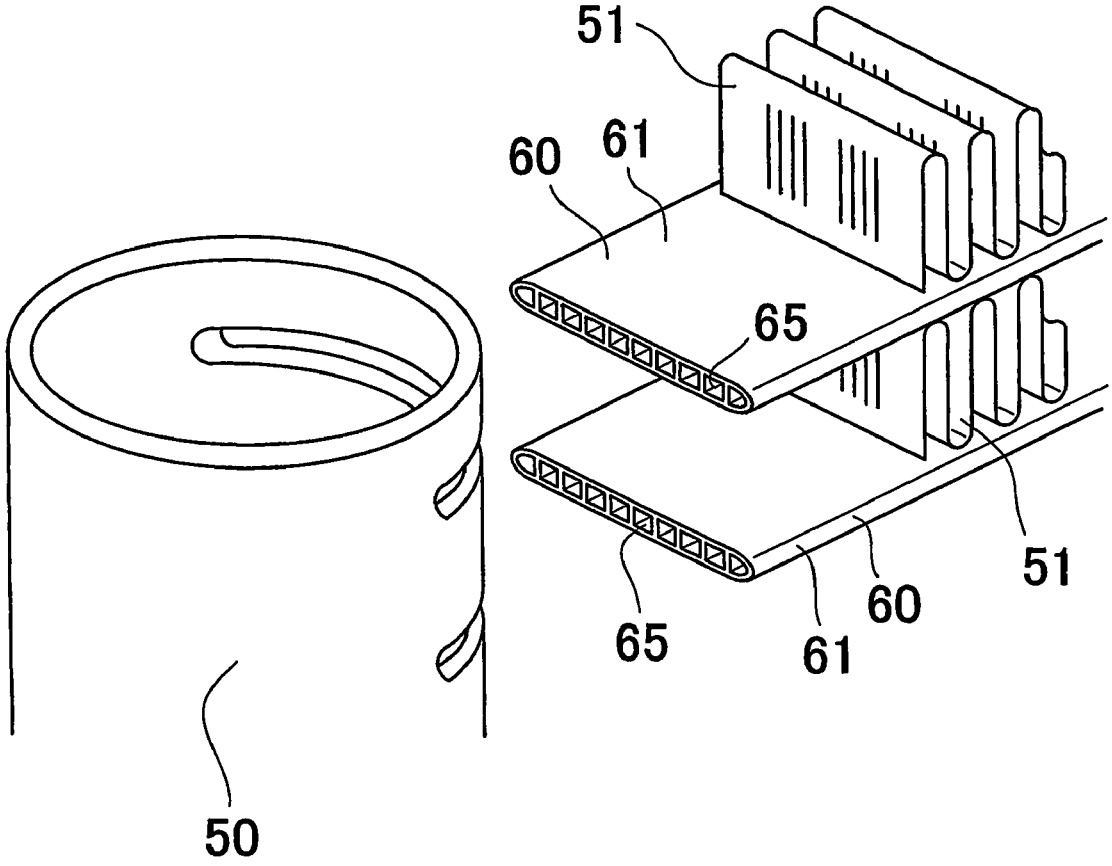
FIG. 2 is an exploded perspective view showing the tube connecting portion of the header of the heat exchanger related to the present invention.

Furthermore, a heat exchanger as shown in FIG. 1 was manufactured by using the aforementioned heat exchanging tubes.

Example 2

As shown in Table 1, in the same manner as in Example 1, heat exchanging tubes were manufactured such that Acwas set to 8.36 $mm^2$, At was set to be 13.5 $mm^2$, P was set to be 101.2 mm, L was set to be 25.3 mm, Ac/At was set to be 62%, P/L was set to be 400%, N was set to be 44 pieces, H was set to be 1.15 mm, W was set to be 12 mm, P/W was set to be 843%, N/W was set to be 3.67 pieces/mm, Ta was set to be 0.06 mm, Tb was set to be 0.1 mm. Furthermore, a heat exchanger was manufactured by using these heat exchanging tubes.

Example 3

As shown in Table 1, in the same manner as in Example 1, heat exchanging tubes were manufactured such that Ac was set to 11.3 $mm^2$, At was set to be 18.1 $mm^2$, P was set to be 131.8 mm, L was set to be 33.3 mm, Ac/At was set to be 63%, P/L was set to be 396%, N was set to be 57 pieces, H was set to be 1.15 mm, W was set to be 16 mm, P/W was set to be 824%, N/W was set to be 3.56 pieces/mm, Ta was set to be 0.06 mm, Tb was set to be 0.1 mm. Furthermore, a heat exchanger was manufactured by using these heat exchanging tubes.

Comparative Example 1

As shown in Table 1, in the same manner as in Example 1, heat exchanging tubes were manufactured such that Ac was set to 22 $mm^2$, At was set to be 46.1 $mm^2$, P was set to be 55 mm, L was set to be 35.4 mm, Ac/At was set to be 48%, P/L was set to be 155%, N was set to be 4 pieces, H was set to be 3 mm, W was set to be 16 mm, P/W was set to be 344%, N/W was set to be 0.25 pieces/mm, Ta was set to be 0.5 mm, Tb was set to be 0.5 mm. Furthermore, a heat exchanger was manufactured by using these heat exchanging tubes.

Comparative Example 2

As shown in Table 1, in the same manner as in Example 1, heat exchanging tubes were manufactured such that Ac was set to 7.15 $mm^2$, At was set to be 18.1 $mm^2$, P was set to be 74.7 mm, L was set to be 32.1 mm, Ac/At was set to be 40%, P/L was set to be 233%, N was set to be 28 pieces, H was set to be 1.15 mm, W was set to be 16 mm, P/W was set to be 467%, N/W was set to be 1.75 pieces/mm, Ta was set to be 0.14 mm, Tb was set to be 0.2 mm. Furthermore, a heat exchanger was manufactured by using these heat exchanging tubes.

Comparative Example 3

As shown in Table 1, in the same manner as in Example 1, heat exchanging tubes were manufactured such that Ac was set to 4.16 $mm^2$, At was set to be 18.1 $mm^2$, P was set to be 59.8 mm, L was set to be 32.1 mm, Ac/At was set to be 23%, P/L was set to be 186%, N was set to be 26 pieces, H was set to be 1.15 mm, W was set to be 8 mm, P/W was set to be 748%, N/W was set to be 3.25 pieces/mm, Ta was set to be 0.1 mm, Tb was set to be 0.1 mm. Furthermore, a heat exchanger was manufactured by using these heat exchanging tubes.

Comparative Example 4

As shown in Table 1, in the same manner as in Example 1, heat exchanging tubes were manufactured such that Ac was set to 6.05 $mm^2$, At was set to be 18.1 $mm^2$, P was set to be 73.3 mm, L was set to be 32.1 mm, Ac/At was set to be 33%, P/L was set to be 228%, N was set to be 32 pieces, H was set to be 1.15 mm, W was set to be 8 mm, P/W was set to be 916%, N/W was set to be 4.00 pieces/mm, Ta was set to be 0.03 mm, Tb was set to be 0.1 mm. Furthermore, a heat exchanger was manufactured by using these heat exchanging tubes.

<Evaluation Test Regarding Weight>

Figure 5:
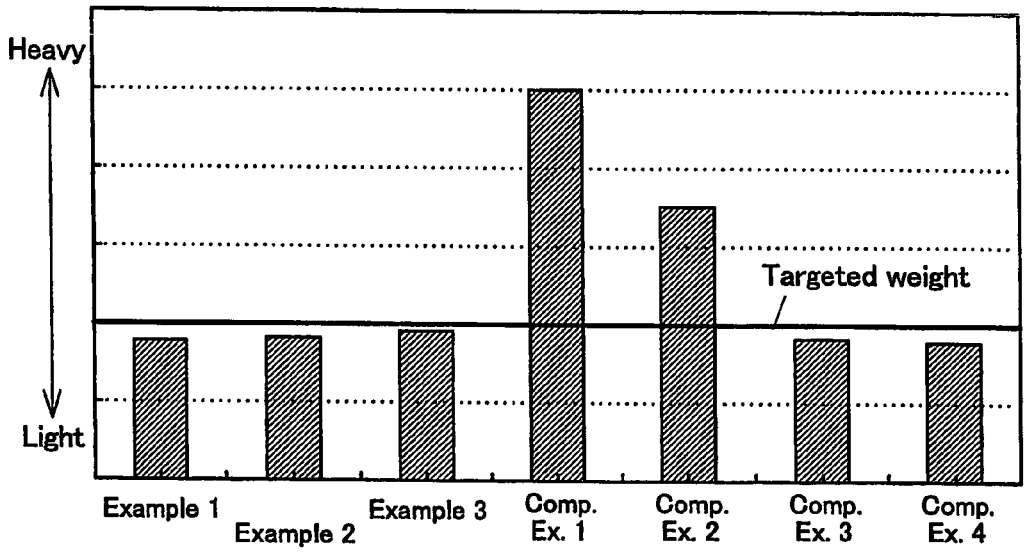
FIG. 5 is a graph showing the relationship between weights of heat exchangers according to the embodiments/comparative embodiments and the targeted weight.

The weight (kg) of each of the heat exchangers of the aforementioned examples and comparative examples was measured. Then, as shown in the graph of FIG. 5, the weights and the targeted weight (the value shown in bold in the graph) of an ideal heat exchanger were compared.

As will be apparent from the graph, the weight of each heat exchanger according to Examples 1, 2 and 3 and Comparative Examples 3 and 4 was lower than the targeted weight, and therefore the analysis shows that they are light in weight. To the contrary, the weight of each heat exchanger according to Comparative Examples 1 and 2 having a larger tube width was higher than the targeted weight.

<Evaluation Test Regarding Pressure Resistance>

Figure 6:
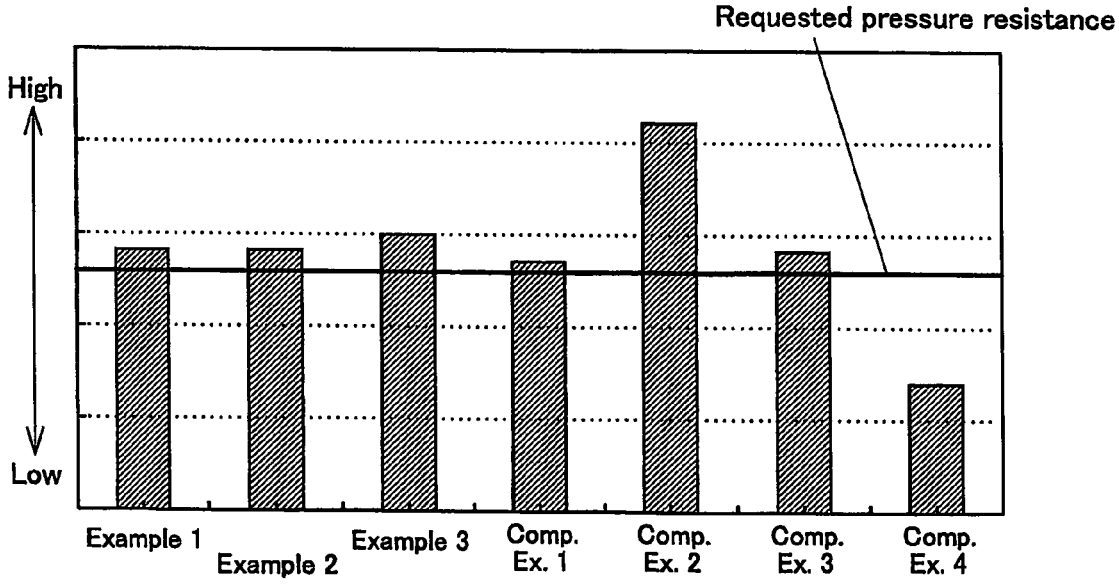
FIG. 6 is a graph showing the relationship between the pressure resistance of heat exchangers according to the embodiments/comparative embodiments and the required pressure resistance.

Each heat exchanger of the aforementioned Examples and Comparative Examples were subjected to a breakdown test to measure the burst pressure (MPa). As shown in the graph of FIG. 6, each burst pressure of each of the heat exchangers and the required burst pressure (the value shown in bold in the graph) of an ideal heat exchanger were compared.

As will be understood from the graph, the heat exchangers according to Examples 1, 2 and 3 and Comparative Examples 1 to 3 having a larger thickness Ta of the partitioning walls had a pressure resistance higher than the required burst pressure, and therefore they had enough pressure resistance. To the contrary, the heat exchanger according to Comparative Example 4 having a smaller thickness Ta of the partitioning wall had a burst pressure less than the required burst pressure.

<Evaluation Test Regarding the Heat Releasing Performance>

Figure 7:
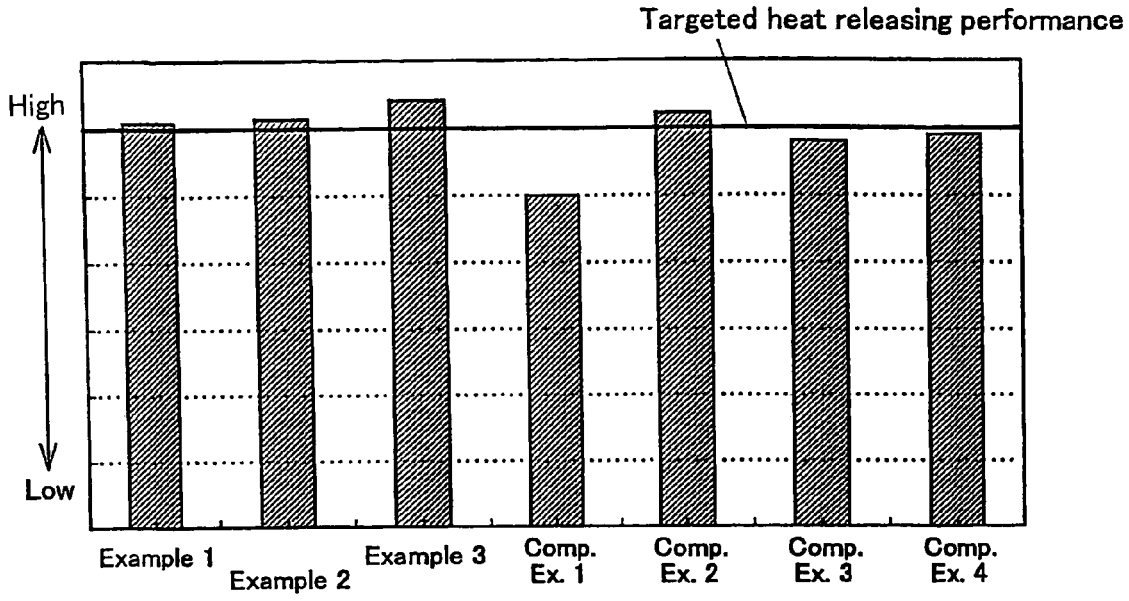
FIG. 7 is a graph showing the relationship between the heat releasing performance of heat exchangers according to the embodiments/comparative embodiments and the targeted heat releasing performance.

The heat releasing amount (kW) of each of the heat exchangers according to Examples and Comparative Examples were measured. As shown in the graph in FIG. 7, each of the heat releasing amounts and the targeted heat releasing amount (the value shown in bold in the graph) were compared.

As will be understood from the above, the heat exchangers according to Examples 1, 2 and 3 and Comparative Example 2 had heat releasing amount larger than the targeted heat releasing amount and had sufficient heat releasing performance. Furthermore, the heat exchangers according to Comparative Examples 3 and 4 had heat releasing amount slightly less than the targeted heat releasing amount. To the contrary, the heat exchanger according to Comparative Example 1 having an extremely higher tube height H had heat releasing amount considerably lower than the targeted heat releasing amount.

<Evaluation Test Regarding Refrigerant Passage Resistance>

Figure 8:
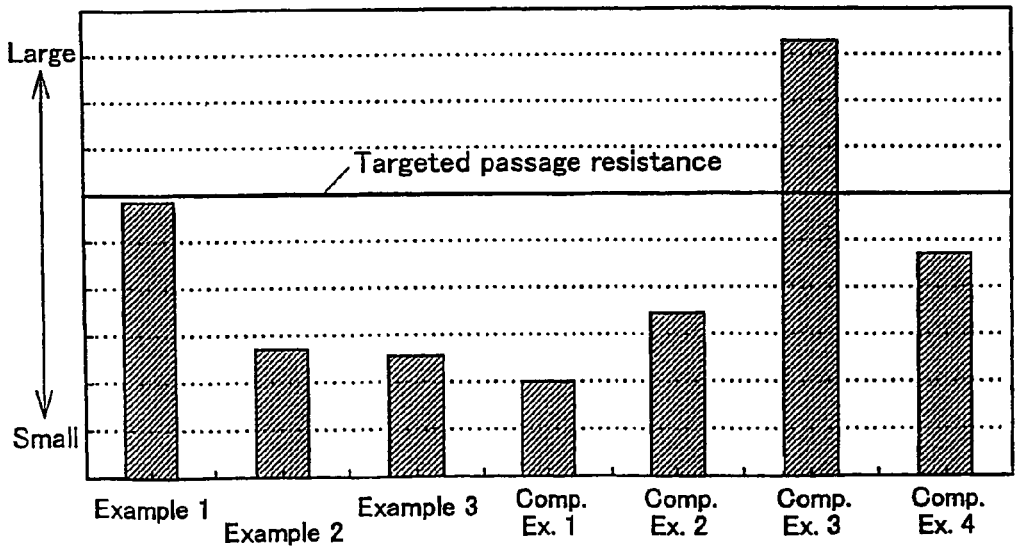
FIG. 8 is a graph showing the relationship between the passage resistances of heat exchangers according to the embodiments/comparative embodiments and the targeted passage resistance.

The refrigerant passage resistance of each of the heat exchangers according to Examples and Comparative Examples were measured. As shown in the graph in FIG. 8, each of the passage resistance and the targeted passage resistance (the value shown in bold in the graph) were compared.

As will be understood from the above, the heat exchangers according to Examples 1, 2 and 3 and Comparative Examples 1, 2 and 4 had passage resistance smaller than the targeted passage resistance and was low in passage resistance. To the contrary, the heat exchanger according to Comparative Example 3 had passage resistance considerably higher than the targeted passage resistance.

<Comprehensive Evaluation>

TABLE 2

| | Weight | Pressure resistance | Heat releasing amount | Passage resistance |
|---|---|---|---|---|
| Example 1 | ○ | ○ | ○ | ○ |
| Example 2 | ○ | ○ | ○ | ○ |
| Example 3 | ○ | ○ | ○ | ○ |
| Comp. Ex. 1 | X | ○ | X | ○ |
| Comp. Ex. 2 | X | ○ | ○ | ○ |
| Comp. Ex. 3 | ○ | ○ | Δ | X |
| Comp. Ex. 4 | ○ | X | Δ | ○ |

The results of each evaluation test regarding weight, pressure resistance, heat releasing performance and passage resistance are shown in Table 2. In this table, "○" denotes a heat exchanger which has attained the target of each evaluation test, "Δ" denotes a heat exchanger which has not been reached the target of each evaluation test but is considered to be reached the practical use level, "X" denotes a heat exchanger which has not reached the targeted of each evaluation test and is difficult to be practically used.

As will be apparent from Table 2, in the heat exchangers according to Examples 1 to 3 which fall within the scope of the present invention, good results were obtained in all evaluations. To the contrary, in the heat exchangers according to Comparative Examples 1 to 4 which fall outside the scope of the present invention, favorable result could not be obtained in any one of the evaluations.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

INDUSTRIAL APPLICABILITY

The heat exchanger and the heat exchanging tube of the present invention can be applied to a condenser or an evaporator for use in a refrigeration cycle of automobile air-conditioners, household air-conditioners, refrigerators, electronics device coolers or the like.

The invention claimed is:

1. A heat exchanging tube comprising:

a flat tube main body having a predetermined length; and a plurality of refrigerant passages extending in a tube longitudinal direction and arranged in a tube widthwise direction, wherein the following relational equations (a) to (c) are satisfied:

$$W=6 \text{ to } 18 \text{ mm} \quad \text{(a)},$$

$$Ac/At\times 100=50 \text{ to } 70\% \quad \text{(b) and}$$

$$P/L\times 100=350 \text{ to } 450\% \quad \text{(c)},$$

where "W" is a width of the tube main body, "Ac" is a total cross-sectional area of the refrigerant passages, "At" is a total cross-sectional area of the tube main body and the refrigerant passages, and "L" is an external perimeter of the tube main body and "P" is a total inner perimeter of the refrigerant passages.

2. The heat exchanging tube as recited in claim 1, wherein the following relational equation (d) is satisfied:

$$P/W\times 100=750 \text{ to } 850\% \quad \text{(d)}.$$

3. The heat exchanging tube as recited in claim 1, wherein the following relational equation (e) is satisfied:

$$N/W=3 \text{ to } 4 \quad \text{(e)},$$

where "N" is the number of refrigerant passages.

4. The heat exchanging tube as recited in claim 1, wherein the following relational equation is satisfied:

$$H=0.5 \text{ to } 1.5 \text{ mm} \quad \text{(f)},$$

where "H" is a height of the tube main body.

5. The heat exchanging tube as recited in claim 1, wherein the following relational equation (g) is satisfied:

$$Ta=50 \text{ to } 80\ \mu\text{m} \quad \text{(g)},$$

where "Ta" is a thickness of the partitioning wall partitioning adjacent refrigerant passages in the tube main body.

6. The heat exchanging tube as recited in claim 1, wherein the following relational equation (h):

$$Tb=80 \text{ to } 250\ \mu\text{m} \quad \text{(h)},$$

where "Tb" is the thickness of the external peripheral wall in the tube main body.

7. The heat exchanging tube as recited in claim 1, wherein the refrigerant passage is approximately rectangular in cross-section.

8. The heat exchanging tube as recited in claim 1, wherein the width W of the tube main body is set to be 6 to 14 mm.

9. The heat exchanging tube as recited in claim 1, wherein the width W of the tube main body is set to be 7 to 12 mm.

10. The heat exchanging tube as recited in claim 1, wherein the following relational equation is satisfied:

$$Ac/At\times 100=55 \text{ to } 65\%.$$

11. The heat exchanging tube as recited in claim 1, wherein the following relational equation is satisfied:

$$P/L\times 100=360 \text{ to } 420\%.$$

12. A heat exchanger comprising:

a pair of headers; and a plurality of heat exchanging tubes arranged in parallel in a header length direction, opposite ends of the heat exchanging tube being connected to the headers in fluid communication, wherein the heat exchanging tube is provided with a flat tube main body having a predetermined length and a plurality of the refrigerant passages extending in a tube longitudinal direction and arranged in a tube widthwise direction, and the following relational equations (a) to (c) are satisfied:

$$W=6 \text{ to } 18 \text{ mm} \quad \text{(a)},$$

$$Ac/At\times 100=50 \text{ to } 70\% \quad \text{(b) and}$$

$$P/L\times 100=350 \text{ to } 450\% \quad \text{(c)},$$

where "W" is a width of the tube main body, "Ac" is a total cross-sectional area of the refrigerant passages, "At" is a total cross-sectional area of the tube main body and the refrigerant passages, and "L" is an external perimeter of the tube main body and "P" is a total inner perimeter of the refrigerant passages.

13. The heat exchanger as recited in claim 12, wherein the width W of the tube main body is set to be 6 to 14 mm.

14. The heat exchanger as recited in claim 12, wherein the width W of the tube main body is set to be 7 to 12 mm.

15. The heat exchanger as recited in claim 12, wherein the following relational equation is satisfied:

$Ac/At \times 100 = 55$ to 65%.

16. The heat exchanger as recited in claim 12, wherein the following relational equation is satisfied:

$P/L \times 100 = 360$ to 420%.

* * * * *